US005520754A

United States Patent [19]

Yaney et al.

[11] Patent Number: 5,520,754

[45] Date of Patent: May 28, 1996

[54] SPRAY CAST AL-LI ALLOY COMPOSITION AND METHOD OF PROCESSING

[75] Inventors: Deborah L. Yaney, Sunnyvale, Calif.; Richard E. Lewis, Incline Village, Nev.

[73] Assignee: Lockheed Missiles & Space Company, Inc., Sunnyvale, Calif.

[21] Appl. No.: 232,802

[22] Filed: Apr. 25, 1994

[51] Int. Cl.[6] ..... C22F 1/04

[52] U.S. Cl. ..... 148/550; 148/549; 148/552; 148/689; 148/690; 148/694; 148/695; 148/698; 148/415; 148/437; 164/46; 420/528; 420/552; 420/590

[58] Field of Search ..... 148/549, 550, 148/552, 689, 690, 694, 695, 698, 415, 437; 164/46; 420/528, 552, 590

[56] References Cited

U.S. PATENT DOCUMENTS

| | | | |
|---|---|---|---|
| 4,661,172 | 4/1987 | Skinner et al. | 148/514 |
| 4,938,275 | 7/1990 | Leatham et al. | 164/46 |
| 5,223,216 | 6/1993 | LaSalle | 148/549 |

FOREIGN PATENT DOCUMENTS 9114011 9/1991 WIPO .

OTHER PUBLICATIONS

P. J. Meschter, R. J. Lederich, J. E. O'Neal, "Microstructure and Properties of Rapid Solidification Processed (RSP) Al–4Li and Al–5Li Alloys," Aluminum–Lithium Alloys III, eds. C. Baker, P. J. Greeson, S. J. Harris, C. J. Peel, Institute of Metals, London, 1986, pp. 85–96.

M. J. Kaufman, A. A. Morone, & R. E. Lewis, "Complictions Concerning TEM Analysis of the δ–AlLi Phase in Aluminum–Lithium Alloys", Scripta Metallurgica, Dec. 1992, vol. 27, pp. 1265–1270.

I. G. Palmer, D. J. Chellman, J. White, "Evaluation of a Spray Deposited Low Density Al–Li Alloy", ICSF2, Swansea, U.K. Sep. 1993.

Nack L. Kim, "Structure and Properties of Rapidly Solidified Al–Li–Cu–Mg–Zr Alloys with a High Zirconium Content", Materials Science & Engineering, Al58 Dec. 1992.

*Primary Examiner*—David A. Simmons
*Assistant Examiner*—Robert R. Koehler
*Attorney, Agent, or Firm*—Feix & Feix; H. Donald Volk

[57] ABSTRACT

A composition and method for producing a low density, high stiffness aluminum alloy which is capable of being processed into structural components having a desired combination of tensile strength, fracture toughness and ductility. The method includes the steps of forming, by spray deposition, a solid Al-Li alloy workpiece consisting essentially of the formula $Al_{bal}Li_aZr_b$ wherein "a" ranges from greater than about 2.5 to 7 wt %, and "b" ranges from greater than about 0.13 to 0.6 wt %, the balance being aluminum, said alloy having been solidified at a cooling rate of about $10^2$ to $10^4$ K/sec. The method further includes several variations of selected thermomechanical process steps for: (1) eliminating any residual porosity which may be present in the workpiece as a result of the spray deposition step; and (2) producing components for a wide range of applications.

29 Claims, 10 Drawing Sheets

LDA AS SPRAY CAST

LDA HIPPED (6 HRS 823K, 15KSI)

PERPEDICULAR TO LONGITUDINAL DIRECTION

PARALLEL TO LONGITUDINAL DIRECTION

EXTRUDED AT 532K

EXTRUDED AT 685K 10
12
CUT SPRAY CAST BILLETS
3-AXIS FORGE
14
12'
HOT ROLL
18
SLAB ROTATED 90°, HOT CROSS ROLLED
12''
20
BLANK IS TRIMMED AND SPUN FORMED AT ELEVATED TEMPERATURE
22
12'''
FORMED LDA DOME

SPRAY CAST AL-LI ALLOY COMPOSITION AND METHOD OF PROCESSING

TECHNICAL FIELD

The present invention relates to aluminum alloys having reduced density and high stiffness. More particularly, the invention relates to ternary (aluminum-lithium-zirconium) alloys formed by spray deposition and then thermomechanically processed into structural components having a desired combination of mechanical properties including tensile strength, fracture toughness and ductility.

BACKGROUND OF THE INVENTION

The recent developments in aluminum-lithium (Al-Li) alloys are of great interest to the aerospace community because of the pronounced effect of lithium on simultaneously decreasing the density and increasing the stiffness of aluminum.

Al-Li alloys produced by conventional casting methods, such as direct chill (DC) casting, are limited to lithium levels of no greater than about 2.5 wt. %. Above this amount, difficulties are encountered in producing sound, high quality ingots that do not contain coarse second phase particles along grain boundaries and which have sufficiently low levels of embrittling hydrogen and alkali metal impurities.

The primary phase responsible for strengthening binary Al-Li alloys is the ordered metastable phase, $\delta'(Al_3Li)$. At temperatures below its well defined solvus line, $\delta'$ is in metastable equilibrium with the aluminum matrix. At temperatures above its solvus line, the equilibrium $\delta$ phase (AlLi) is formed.

Zirconium is typically added to aluminum alloys in order to control grain size and retard recrystallization. Zirconium reacts with aluminum to form $Al_3Zr$ which, depending upon zirconium concentration and cooling rate, can have either a metastable cubic or equilibrium tetragonal crystal structure. However, only the cubic phase, which forms as fine, spherical particles is effective in controlling grain size and retarding recrystallization. Metastable cubic $Al_3Zr$ has the $Ll_2$ crystal structure and is isomorphous with the primary strengthening phase in Al-Li alloys, $\delta'$. Cubic $Al_3Zr$ acts as a preferred site for precipitation of $\delta'$ in Al-Li alloys, but unlike $\delta'$, is highly resistant to dislocation shear. In sufficient quantity, cubic $Al_3Zr$ reduces the tendency for planar slip in Al-Li alloys thereby improving alloy strength as well as ductility. In DC cast alloys, the maximum amount of zirconium that can typically be added is 0.13 wt. %. Beyond this level, large, needle shaped particles of tetragonal $Al_3Zr$, which do not have any microstructural benefit, are formed instead.

It is recognized in the art that alloy production methods with cooling rates greater than that of DC casting can be used to refine grain size, suppress the formation of large second phase particles along grain boundaries, increase the amount of zirconium that can be added to an alloy without formation of tetragonal $Al_3Zr$, and reduce hydrogen and sodium levels in the end product. One such solidification technique, is rapid solidification processing (RSP).

In accordance with the typical RSP method, the alloy is rapidly solidified from the melt into either powders or continuous ribbons (which are subsequently comminuted into powder form). The powders are then consolidated into bulk compacts. The consolidation step involves one or more conventional powder metallurgy processing techniques including, direct powder rolling, vacuum hot compaction, forging, extrusion, etc.

A disadvantage of RSP methods, especially as applied to the production of Al-Li alloys is that, complex Al-Li oxides which form quickly on the surface of rapidly solidified powders, are often retained in the consolidated product as continuous stringers or as a semi-continuous network along prior particle boundaries. The oxides act as preferred sites for crack initiation and propagation resulting in an alloy with poor ductility and fracture toughness. Also, because of the hydrated nature of the Al-Li oxide films, the hydrogen level of the alloy can be adversely increased. U.S. Pat. No. 4,661,172 issued to Skinner, et al. discloses a family of low density Al-Li-Cu-Mg-Zr alloys formed by the RSP method. The alloys contain lithium levels ranging between 3.5 and 4.0 wt. % and zirconium levels ranging between 0.2 and 1.5 wt. %. The alloys disclosed by Skinner, et al. exhibit good strength, but have less than optimum ductility and fracture toughness because of the presence of oxides at prior particle boundaries.

In view of the large number of steps typically involved in consolidating rapidly solidified materials, RSP Al-Li alloys are not economically competitive with alloys produced by more direct methods such as DC casting. In addition, the production of billets weighing thousands of pounds, which occurs routinely by DC casting, is extremely difficult, if not impossible, using RSP methods. For these reasons, researchers have turned to alternate methods for production of Al-Li alloys with lithium contents in excess of 2.5 wt. %.

A more economical method for producing Al-Li alloys is a process known as spray casting or spray/brining. The spray casting method is described in detail in U.S. Pat. No. 4,938,275 issued to Leatham, et al.

Unlike RSP, there are no practical limitations restricting the size of billets that can be produced by spray casting. Cooling rates during spray casting are not as rapid as those associated with RSP. However, they are significantly higher than those encountered during DC casting.

Al-Li alloys produced by the spray cast method and having moderately high Li content (i.e., about 2 wt. %) are known from the prior art. For example, U.S. Pat. No. 5,223,216 issued to Lasalle discloses a spray cast Al-Li alloy having the composition Al-2.1Li-1.0Cu-0.4Mg-0.6Zr. Further, published WIPO document No. WO 91/14011 (International Application No.: PCT/GB91/00381) discloses a spray cast Al-Li alloy having the composition Al-2.68Li-1.73Cu-0.86Mg-0.11Zr.

A spray cast Al-Li alloy containing 4 wt. % Li is also known in the prior art. For example, Palmer, Chellman and White ("Evaluation of a Spray Deposited Low Density Al-Li Alloy, ICSF2, Swansea, U.K. September 1993) disclose a medium strength spray cast alloy having the composition Al-4.0Li-0.2Zr. The lithium level of this composition was specifically selected to be close to but less than the maximum solid solubility of lithium in aluminum (approximately 4.2%) in order to achieve the lowest possible density while avoiding the formation of a large amount of the $\delta$ phase, AlLi, which these authors report is detrimental to ductility and fracture toughness.

Earlier research in the field of RSP Al-Li alloys also suggests that good ductility cannot be achieved in Al-Li alloys containing greater than 4 wt. % Li. See, for example, Meschter, Lederich and O'Neal ("Microstructure and Properties of Rapid Solidification Processed (RSP) Al-4Li and Al-5Li Alloys", Aluminum-Lithium Alloys III, 1986, p. 87). This paper describes an RSP Al-5Li-0.2Zr composition that has been extruded, solution heat treated and peak aged and indicates that the 10 percent minimum volume fraction of δ phase which is always present in Al-5Li alloys is twice as high as the generally recognized maximum level below which acceptable ductility and an acceptable strength/ductility ratio are achieved.

As can be seen from the above discussion, the prior art does not teach or suggest spray cast Al-Li alloys which combine both a higher than usual zirconium content (i.e. greater than about 0.13 wt. %) with a lithium content in the 5 wt. % range. Thus, there is a continuing need in the art for a family of ternary (Al-Li-Zr) alloys and method for producing the same which have both a high zirconium content for grain refinement and increased matrix shear resistance and a high lithium content (in excess of 4 wt. %) for density reduction and high stiffness.

SUMMARY OF THE INVENTION

List of Objects

It is a primary object of the present invention to provide a composition and method for producing by spray forming a family of reduced density, high stiffness ternary (Al-Li-Zr) alloys having good mechanical properties and which are workable to form useful and commercially feasible structural components, such as, for example, structures for aerospace applications.

It is another object of the invention to provide a method for producing a ternary (Al-Li-Zr) alloy as described herein which combines the benefits of high production rate and low cost afforded by conventional casting methods (e.g. direct chill or "DC" casting) with the benefits of reduced second phase formation and fine microstructure afforded by rapid solidification processing (RSP) methods.

Methods and compositions which incorporate the desired features described above and which are effective to function as described above constitute specific objects of this invention.

The present invention provides a novel composition for a family of ternary (Al-Li-Zr) alloys and a low cost method for producing the same into billets which can be thermomechanically processed to form structural components which have a good combination of mechanical properties including strength, ductility and fracture toughness.

The alloys of the present invention consist essentially of the formula $Al_{bal}Li_aZr_b$ wherein "a" ranges from greater than about 4.4 to 7 wt %, and "b" ranges from about 0.08 to 0.6 wt %, the balance being aluminum. In a preferred embodiment of the invention, "a" ranges from greater than about 4.4 to 6 wt %, and "b" ranges from greater than about 0.13 to 0.5 wt %.

In accordance with the method aspects of the invention, the alloys are formed as spray cast billets in accordance with the known spray deposition process. Contrary to the teachings of the prior art, we have found that by employing the spray deposition process in combination with discreet thermomechanical processing, we are able to produce a workable and commercially feasible, intermediate strength ternary Al-Li-Zr alloy composition having lithium levels in excess of 4 wt % and preferably 5 wt % or more, thus achieving the lowest practical density. We also have developed a thermomechanical processing sequence to redistribute the formation of large amounts of δ(AlLi) phase throughout the matrix to improve ductility and fracture toughness.

The rapid cooling rate afforded by the spray deposition process (preferably in the range of about $10^2$ to $10^4$ K/sec) permits addition of higher levels of lithium and zirconium than are practical with conventional ingot casting techniques. High levels of zirconium (preferably on the order of 0.13 wt % or more) are also added to alloys in order to form the metastable $Al_3Zr$ phase for grain size control and increased shear resistance of the matrix.

In accordance with the present invention, a billet (or "workpiece") is subjected to a sequence of thermomechanical processing steps to consolidate the 1–3% residual porosity characteristically present in spray cast billets. This is followed by heat treatment to obtain a desired combination of mechanical properties in the finished product.

In one embodiment, a hot isostatic pressing procedure (HIPping) is employed to eliminate the residual porosity of the spray cast workpiece. The HIPping procedure also retains the fine grain structure of spray cast material. The workpiece is then subjected to a heat treatment sequence including solution heat treating at an elevated temperature to maximize the amount of Li in solid solution followed by rapid cooling to maximize the amount of Li retained in solid solution at room temperature. The workpiece is then aged at a slightly elevated temperature until a desired combination of mechanical properties including yield strength, ductility and fracture toughness is obtained.

In another embodiment, the heat treatment sequence further includes immersing the quenched workpiece in a liquid nitrogen bath allowing the temperature of the workpiece to stabilize followed by upquenching to an elevated temperature prior to aging. The additional liquid nitrogen bath/upquench sequence has been found beneficial in providing dimensional stability to the workpiece thereby limiting damage or warpage to the finished product.

In a further embodiment of the invention, the spray cast workpiece is extensively thermomechanically processed via a sequence of hot working steps including forging, rolling and spin forging in order to produce an end product of desired structural configuration. In example 4 described below, the workpiece has been thermomechanically processed to form an end dome for a cryogenic tank. It has been discovered that the extensive hot metal working steps provide the benefits of finer microstructure and a redistribution the δ-phase AlLi throughout the material thereby improving fracture toughness and ductility.

The end dome is preferably subjected to a damage tolerant heat treatment and aging sequence as described above. An interesting observation is that there is an unexpected increase in the fracture toughness of the material for intermediate aging times before tapering off at peak aging. This results in greater flexibility in the amount of useful combinations of mechanical properties that are obtainable. A welding trial was also performed to demonstrate the commercial utility of the Al-Li-Zr alloy.

In yet another embodiment, a hot extrusion process is employed to demonstrate an alternate method for eliminating the residual porosity of the spray cast workpiece and to further demonstrate how the Al-Li-Zr alloys can be formed into complex shapes for a wide variety of potential applications.

Other and further objects of the present invention will be apparent from the following description and claims and are illustrated in the accompanying drawings, which by way of example, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1*a* is an optical micrograph of a spray cast billet having the composition Al-5.11Li-0.17Zr and shows a single large pore which appears as a single black spot located in the center of the micrograph. Note the smaller dark spots indicate the δ(AiLi) phase. A 1–3% level of residual porosity is typical in Al-Li billets formed by the spray deposition process.

FIG. 1*b* is an optical micrograph of the spray cast billet of FIG. 1*a* shown after hot isostatic pressing (HIPping) at 823° K. and 15 ksi for 6 hours. FIGS. 2*a*–2*b* is a two part series of optical micrographs showing radial and longitudinal cross sections, respectively, of an alloy billet having the composition Al-4.99Li-0.08Zr which has undergone HIPping at 843° K. and 15 ksi for 6 hours. This series of optical micrographs illustrates how HIPping retains the substantially uniform microstructure characteristic of spray cast materials.

FIGS. 3*a*–3*b* is a two part series of optical micrographs of an alloy composition Al-4.98Li-0.14Zr which was annealed for 100 hours at 848° K. and then extruded with a 20:1 reduction ratio at 573° K. (FIG. 3*a*) and 685° K. (FIG. 3*b*).

FIGS. 4*a*–4*c* is series of graphs illustrating the effect of aging time on the room temperature strength, fracture toughness, and ductility of a spray cast alloy having the composition Al-4.99Li-0.08Zr which has undergone thermomechanical processing of the type required for fabrication into structural components for aerospace applications, wherein: FIG. 4*a* is a graph plotting the 0.2% offset yield strength and ultimate tensile strength as a function of aging time at 423° K.; FIG. 4*b* is a graph plotting apparent fracture toughness as a function of aging time at 423° K.; and FIG. 4*c* is a graph plotting percent elongation to failure as a function of aging time at 423° K..

DETAILED DESCRIPTION OF THE PREFERRED EMBODIMENTS

The invention provides a reduced density, medium strength ternary Al-Li-Zr alloy produced as billets using the spray deposition process.

The novel composition for the low density, high stiffness ternary Al-Li-Zr alloy and method for producing the same into useful structural components is illustrated through the following examples. The specified techniques, conditions, ranges, materials, proportions and reported data set forth in the examples are presented to provide a more complete understanding of the principles and practice of the invention. It is understood that many variations and modifications, for example, in the temperature and pressure ranges for thermomechanically working the ternary Al-Li-Zr alloy, when employed by those skilled in the art, may be practiced without departing from the spirit and scope of the present invention as defined by the claims.

EXAMPLE 1

Figure 1A:
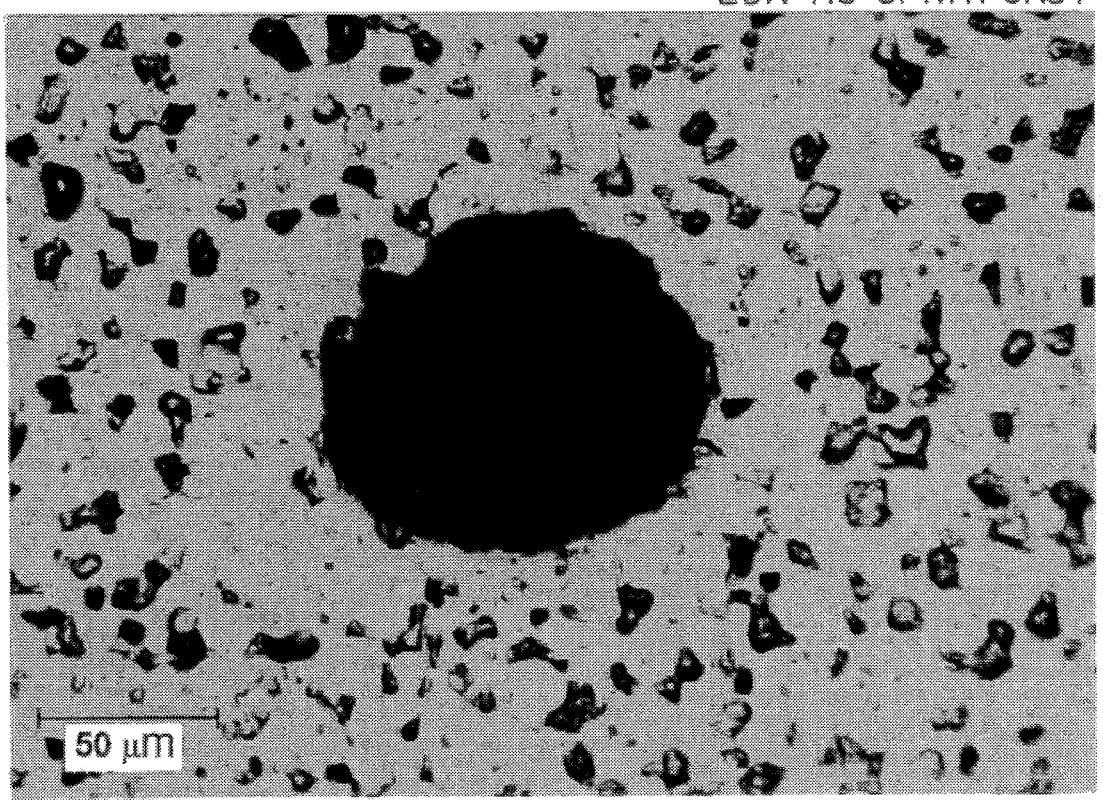
Figure 1B:
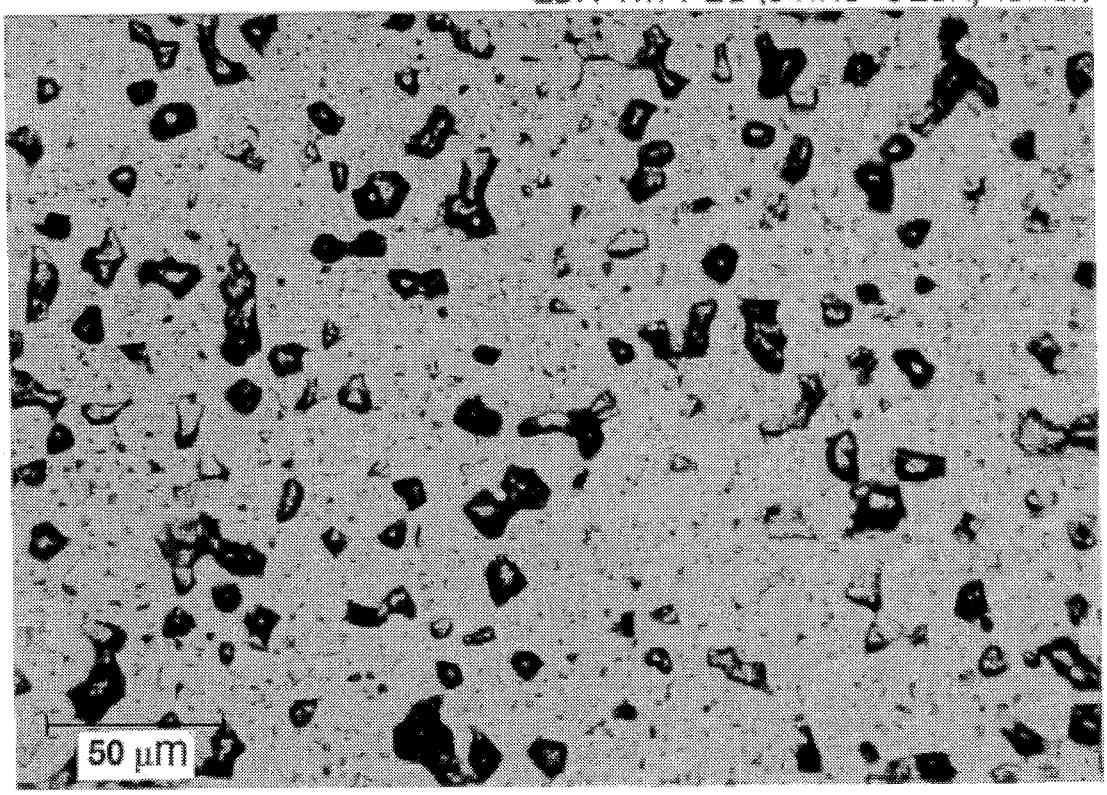

This example illustrates the use of hot isostatic pressing (HIPping) to eliminate the 1 to 3 percent residual porosity characteristic of as-spray cast billets. Pores in "as-sprayed" alloys vary in size with the largest having diameters of approximately 100 μm. An optical micrograph of a large pore in a spray cast Al-5.11Li-0.17Zr alloy is shown in FIG. 1*a*. Following HIPping for 6 hours at 823° K. and 15 ksi, all traces of porosity are eliminated and some of the δ phase has reprecipitated within grains rather than along grain boundaries. This is illustrated in FIG. 1*b*.

Figure 2A:
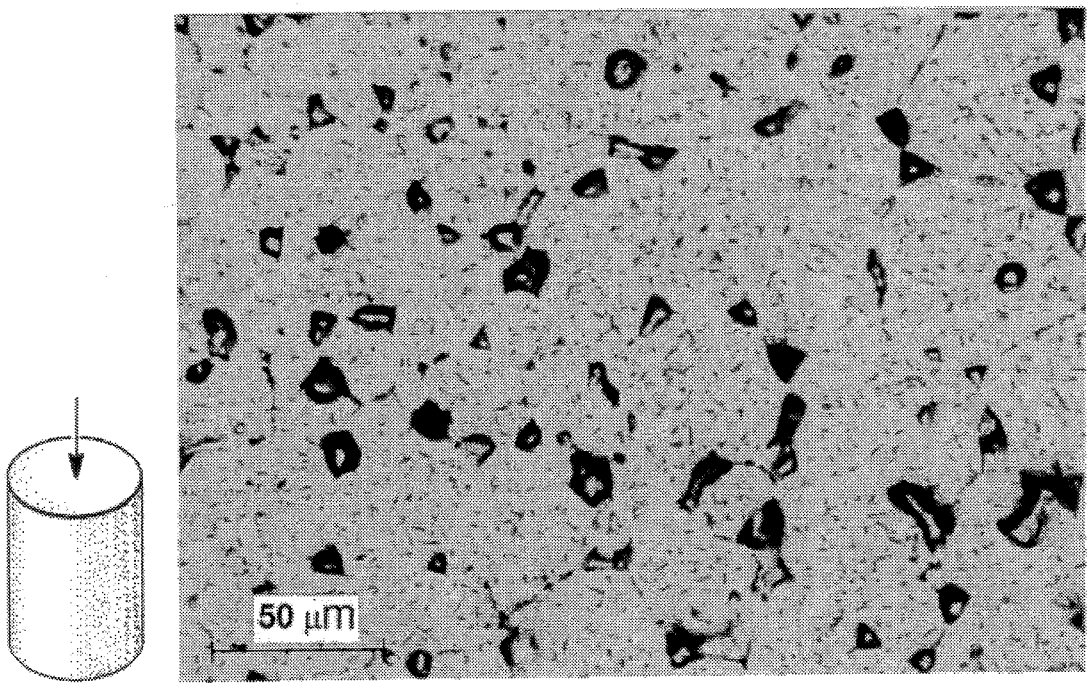
Figure 2B:
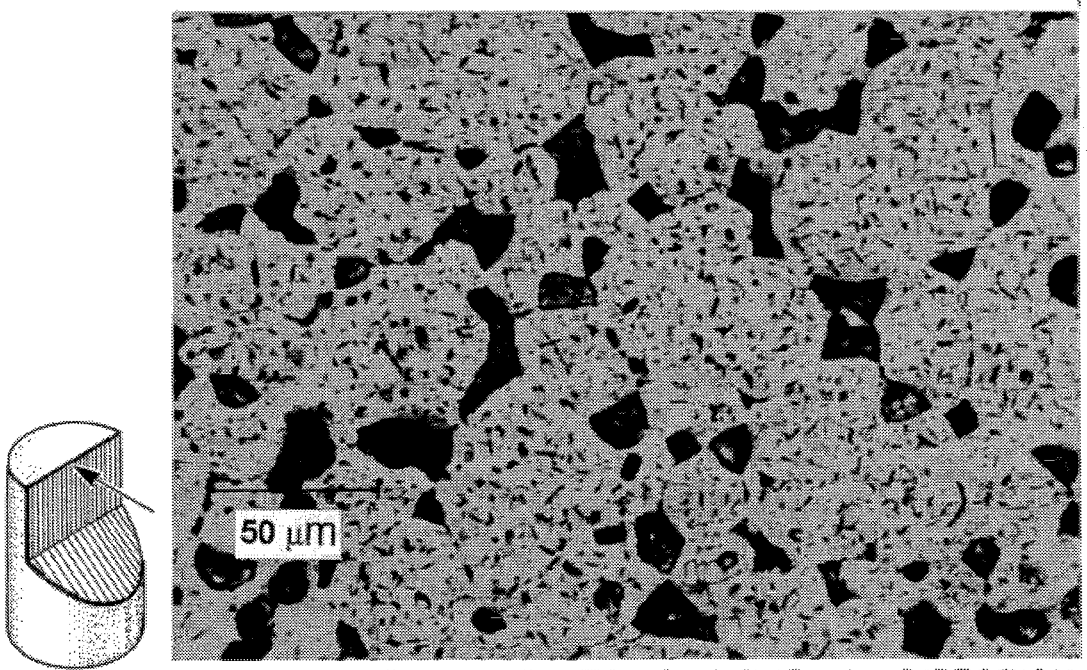

HIPping also retains the fine, uniform microstructure characteristic of spray cast materials. This is best seen with reference to the optical micrographs of FIG. 2*a* and FIG. 2*b* which show radial and longitudinal cross sections, respectively, of an Al-4.99Li-0.08Zr alloy HIPped for 6 hours at 843° K. and 15 ksi. Note that the microstructures of the two orientations are virtually identical in appearance. The grain size in both as-sprayed and HIPped materials is approximately 50 μm. Tensile properties of a spray cast Al-5.11Li-0.17Zr alloy that has been HIPped for 6 hours at 823° K. and 15 ksi, solution heat treated at 843° K., water quenched, and aged for 16 hours at 423° K. are shown in Table 1. The uniformity of the spray cast and HIPped microstructures results in tensile properties which do not vary significantly as a function of orientation with respect to the original spray cast billet.

TABLE 1

| Orientation | Yield Strength (ksi) | Ultimate Strength (ksi) | Percent Elongation to Failure |
|---|---|---|---|
| Radial | 35.4 | 40.6 | 1.8 |
| Circumferential | 36.4 | 40.4 | 1.6 |
| Longitudinal | 37.0 | 41.0 | 1.2 |

EXAMPLE 2

Figures 3A, 3B:
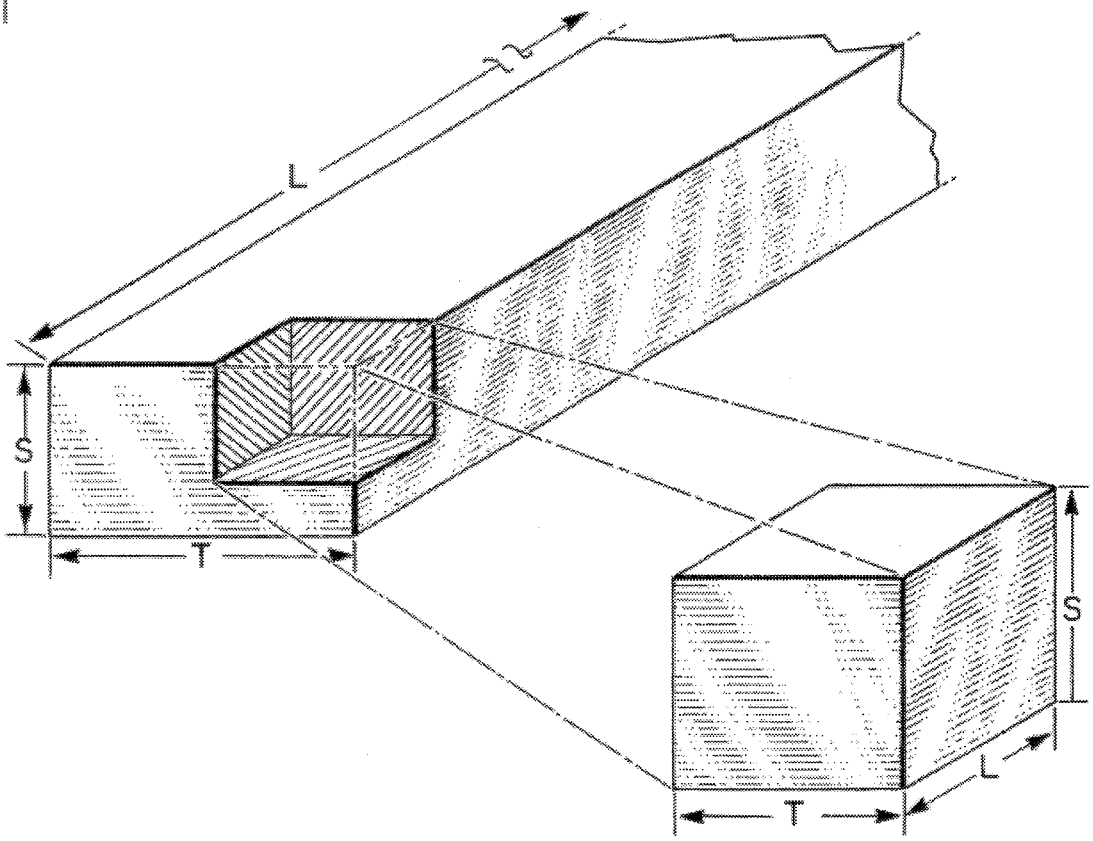
Figure 3A:
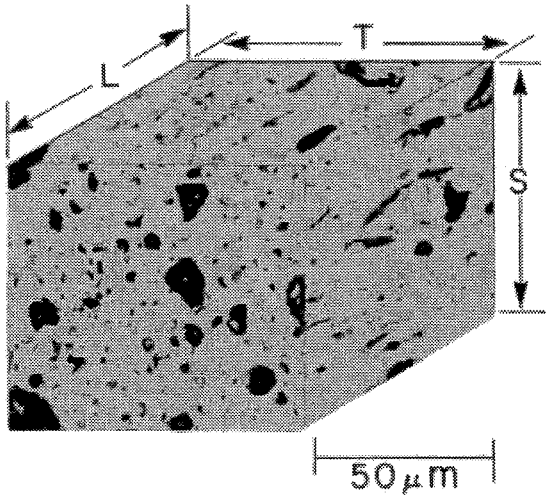
Figure 3B:
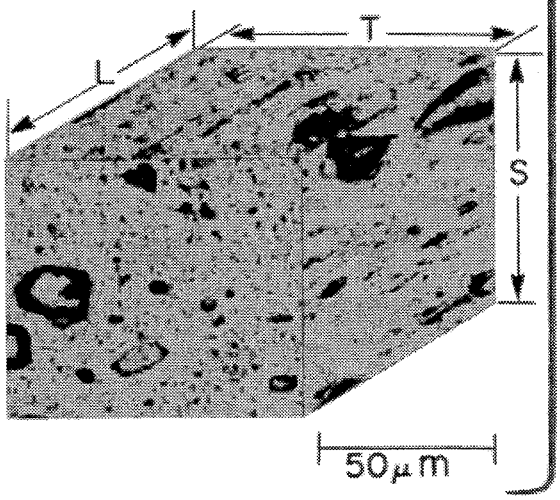

This example illustrates the use of extrusion to: (1) eliminate the 1 to 3 percent residual porosity inherent in spray cast billets and, (2) form spray cast, Al-Li-Zr alloys into desired shapes for a wide variety of potential applications. Optical micrographs of a spray cast Al-4.98Li-0.14Zr alloy that was annealed for 100 hrs. at 848° K. prior to extrusion (20:1 reduction) at 573° and 685° K. are shown in FIG. 3*a* and FIG. 3*b*, respectively. No residual porosity is apparent. Similar results were obtained for an Al-4.88Li-0.14Zr alloy that had been HIPped for 6 hours at 843° K. and 15 ksi, as well as annealed for 100 hours at 848° K., prior to extrusion (20:1 reduction) at 573° and 685° K.

EXAMPLE 3

Figure 4A:
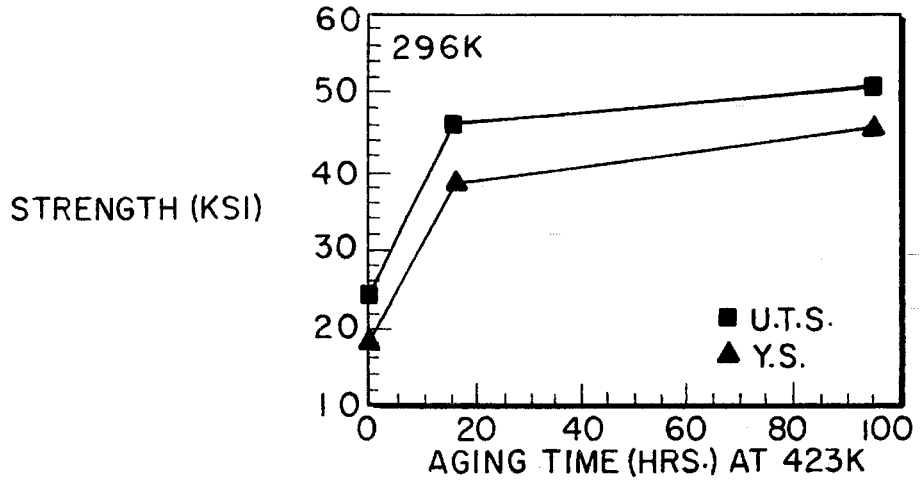

This example demonstrates the effect of aging time at 423° K. on the room temperature strength, ductility, and fracture toughness of a spray cast Al-4.99Li0.08Zr alloy that has undergone extensive thermomechanical processing similar to that which might be required to fabricate structural components for space based platforms. Specifically, the thermomechanical processing sequence used involved the following: (a) HIP (6 hrs., 843° K., 15 ksi), (b) uniaxially forge (63% reduction) at 773° K., (c) round roll (63% reduction in thickness) at 773° K., (d) straight roll (10 percent reduction in thickness) at 673° K., (e) solution heat treat at 848° K. and water quench. The 0.2 percent offset yield strength and ultimate tensile strength of the material just described is plotted as a function of aging time at 423° K. in FIG. 4*a*. It should be noted that the data points for zero aging time correspond to thermomechanically processed material prior to solution heat treatment and aging.

Figure 4B:
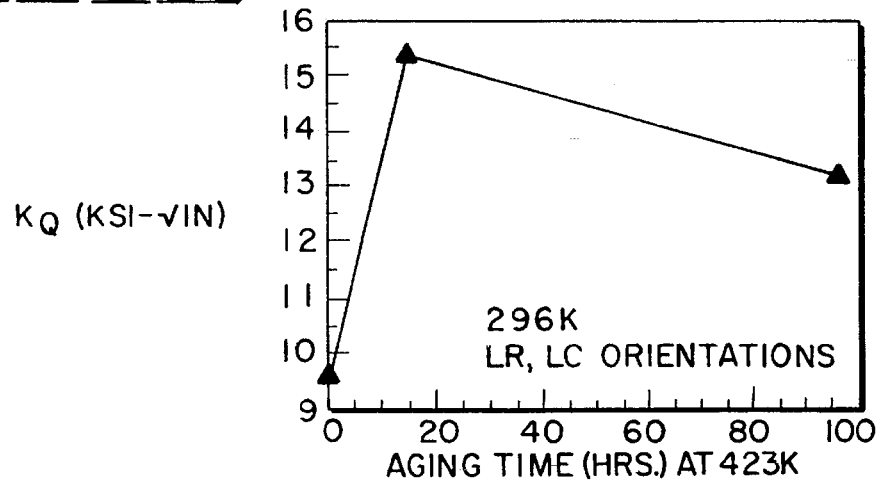
Figure 4C:
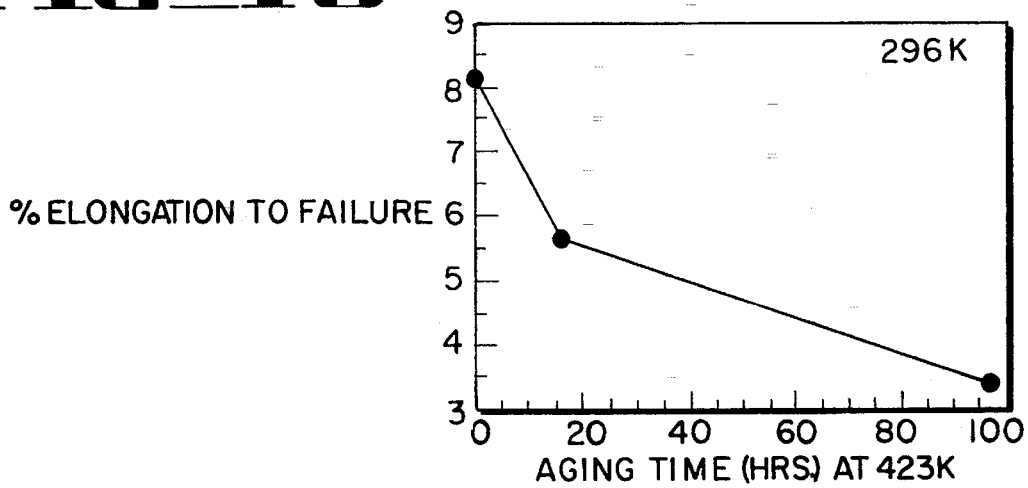

In FIG. 4*b* and FIG. 4*c*, apparent fracture toughness and percent elongation to failure, respectively, are plotted as a function of aging time at 423° K. Once again, the data points for zero aging time correspond to thermomechanically processed material prior to solution heat treatment and aging. By simply air cooling from the final rolling temperature, most of the lithium in solution at the elevated temperature is able to precipitate out during cooling to form the equilibrium δ phase.

In contrast, if the material is solution heat treated following rolling, δ phase is dissolved until a maximum amount of lithium is placed into solution. During quenching, some lithium reacts to form the metastable strengthening phase, $Al_3Li$ or δ', while most is retained in solid solution. Thus, as seen in FIG. 4, the material corresponding to zero aging time has the largest volume fraction of δ phase. This phase is typically cited by the experts in this field as the primary cause for low ductility in Al-Li alloys with lithium contents in excess of 4 percent. As noted above, previous research indicates that the 10 percent minimum volume fraction of δ phase present in Al-5%Li alloys is twice the maximum level below which an acceptable ductility and strength/ductility ratio are still obtainable.

As can be seen in FIG. 4, the amount of δ phase present in an Al-Li alloy does not always determine its ductility or its strength/ductility ratio. In this example, it is the material with the highest volume fraction of δ phase which exhibits the highest ductility and the lowest strength/ductility ratio. The reason for this behavior has to do with the fact that through appropriate thermomechanical working, the microstructure has been refined and the δ phase re-distributed. This is best understood with reference again to the optical micrographs of as-cast and HIPped Al-5.11Li-0.17Zr (FIGS. 1*a* and 1*b*), which show that the δ phase resides primarily at grain boundary triple junctions. Following thermomechanical processing, the percentage of δ phase along the grain boundaries is decreased. As a result, the propensity for the kind of grain boundary failure and low ductility seen in the as-HIPped material of Table 1 is reduced.

With respect to fracture toughness, the as-rolled material, without solution heat treatment and aging, despite its good ductility, exhibits the lowest fracture toughness of all conditions investigated. In view of the low strength of Al-Li-Zr alloys prior to aging, crack initiation and propagation is associated with extensive crack tip plasticity. Unlike most materials, the strength of the matrix must be increased by aging to preciptitate δ' in order for the material to exhibit acceptable fracture toughness.

EXAMPLE 4

Figure 5:
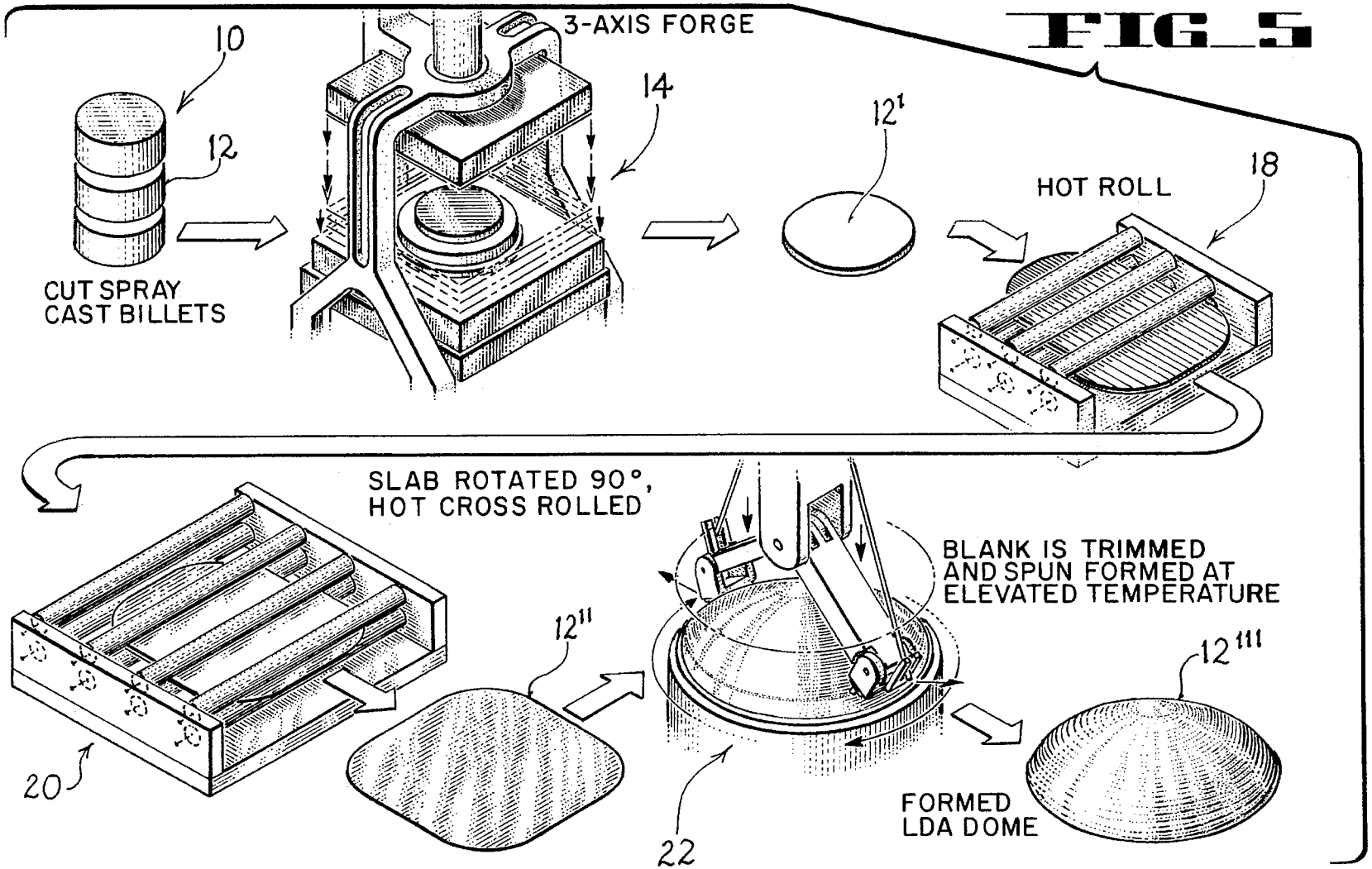
FIG. 5 is a flow diagram illustrating, by way of example, a sequence of thermomechanical processing steps used for producing a low density alloy end dome (herein referred to as "LDA" dome) for a cryogenic tank from a spray cast billet of material having the composition Al-5.11Li-0.17Zr.

FIG. 5 illustrates the metal working steps involved in fabricating an end dome for a cryogenic tank from a spray cast Al-5.11Li-0.17Zr alloy (herein referred to as low density alloy or "LDA" dome). Initially, a spray cast billet (or "workpiece") 10 is trimmed to remove its rough, as-cast surface layer. A 6.25 in. thick section 12 is then cut from the 10.9 in. diameter trimmed billet and subjected to a 3-axis forging operation at temperatures ranging from 648° to 823° K. This is indicated generally at reference numeral 14. The end product of the forging operation is a slab 12' with approximate dimensions of 16×16×2.25 in. Following forging, the slab 12' is cross-rolled (10–20 percent reduction per pass) at temperatures in the range of 648° to 823° K. until a slab 12" having final dimensions of approximately 31×31×0.6 in. is obtained. The cross rolling steps are indicated generally at reference numerals 18 and 20. In both the forging and rolling steps, intermediate re-heating is used, as required, to keep the temperature of the workpiece in the desired range. In order to form the final LDA dome 12''', a 30 in. diameter disc is cut from the rolled plate, heated to a temperature in the range of 653° to 823° K. and spun to final configuration. This step is indicated generally at 22. A damage tolerant heat treatment similar to that described in Example 3 is then applied. Specifically, the LDA dome is solution heat treated at 843° K., glycol quenched, stabilized in liquid nitrogen, upquenched using hot water, and aged for 16 hours at 423° K.

Figure 6:
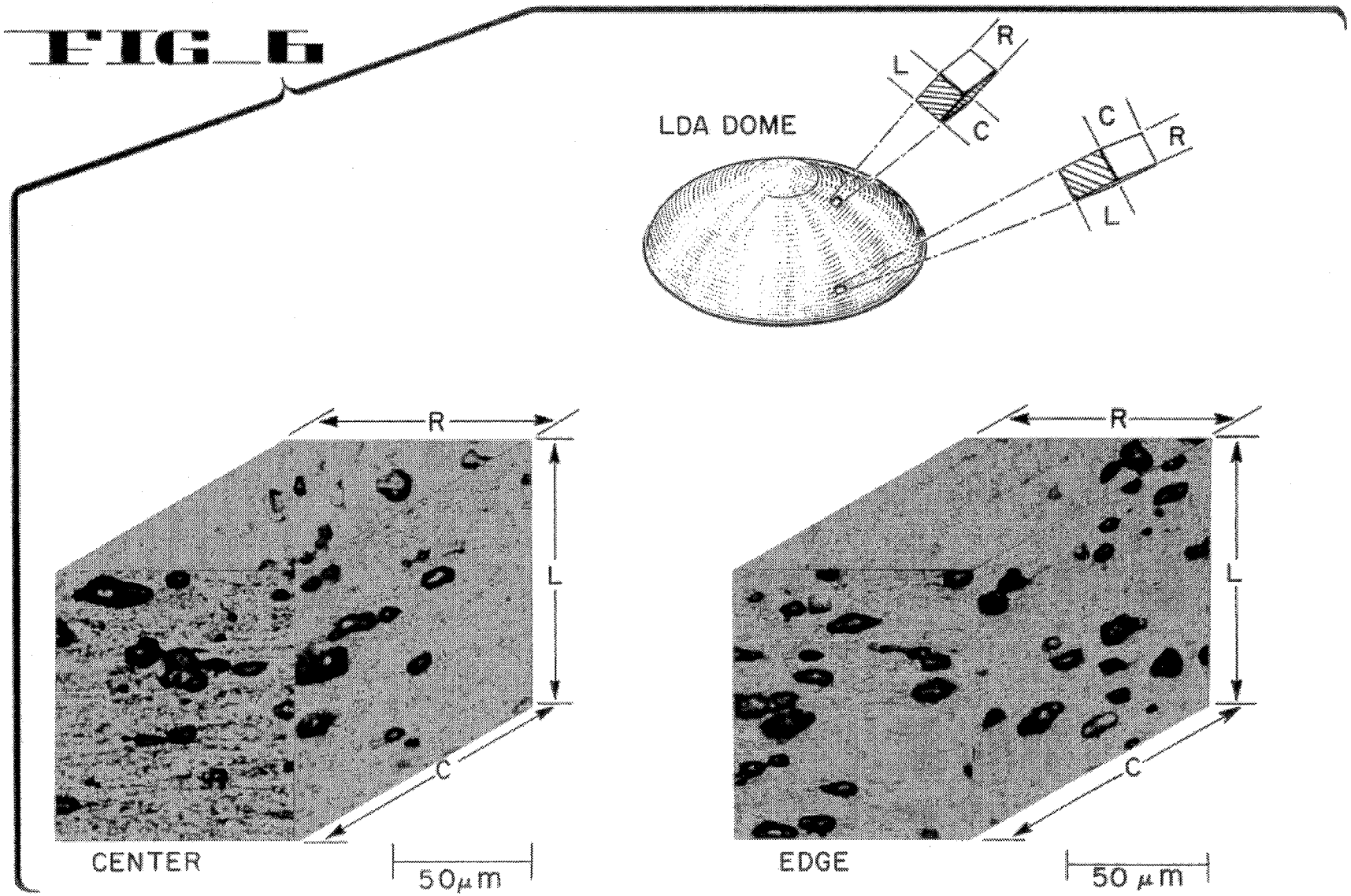
FIG. 6 shows a series of three-dimensional optical micrographs taken at the center and at the outer edge of the LDA dome after final heat treatment. Extensive thermomechanical processing has produced considerable microstructural refinement in comparison with the as-spray cast material of FIGS. 1*a*–1*b* and the HIPped material of FIGS. 2*a*–2*b*.

Optical micrographs of the LDA dome after final heat treatment are shown in FIG. 6. In comparison to both as-spray cast and HIPped material, the microstructure obtained after extensive metal working is considerably finer. A re-distribution of the δ-phase has also taken place. During spinning, the thickness of the LDA dome is reduced more at the edge than at the center. As a result, the microstructure of the LDA dome is slightly more refined at the edge than at the center.

Figure 7:
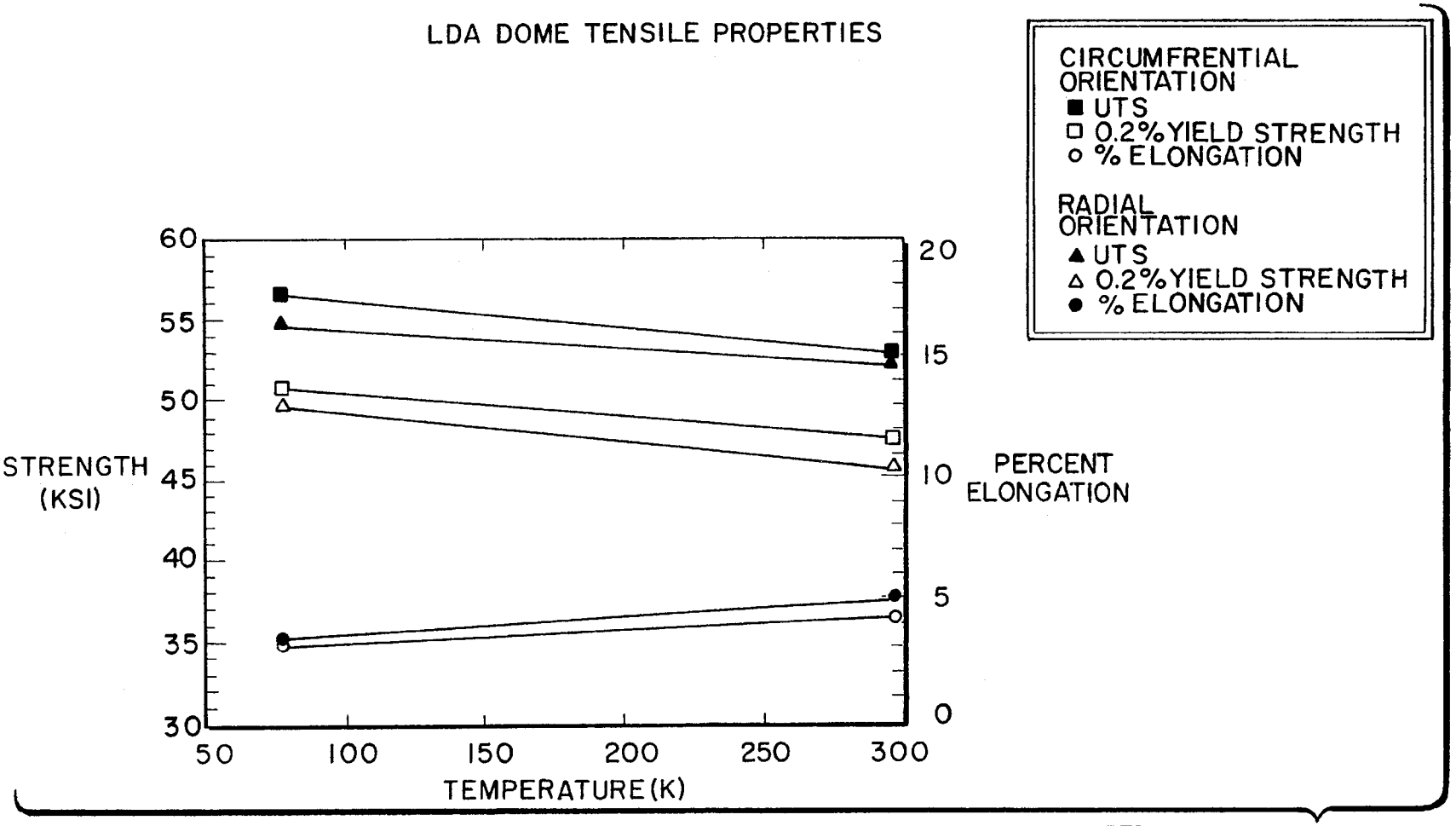
FIG. 7 is a graph plotting 0.2% offset yield strength, ultimate tensile strength and percent elongation to failure as a function of test temperature for the LDA dome of FIG. 5.

In FIG. 7, the values for 0.2 percent offset yield strength, ultimate tensile strength and percent elongation to failure for the LDA dome are plotted as a function of test temperature. Despite the slightly greater degree of microstructural refinement seen at the edge of the dome, no corresponding variation in tensile properties was recorded. Only a slight variation is seen between samples tested in the radial direction versus samples tested in the circumferential direction. In comparing the results of room temperature tensile tests performed on the dome, to results of room temperature tests performed on HIPped material subjected to the same solution heat treatment and aging sequence (see e.g., Table 1), it is apparent that the reduction in grain size, increased dislocation substructure, and redistribution of the δ-phase that results from extensive thermomechanical processing has a beneficial effect on the tensile properties of spray cast Al-5.11Li-0.17Zr. The end result is an alloy that combines low density, high stiffness and intermediate strength with acceptable values of ductility and fracture toughness.

A comparison of selected properties of the Al-5.11Li-0.17Zr dome with those of a spray cast Al-4Li-0.2Zr alloy that has been processed in a similar fashion is given in Table 2 below.

TABLE 2

| Alloy | Yield Str. (ksi) | Elong-ation (%) | Kq (ksi√in) | Density (lb/in$^3$) | E ($10^6$ psi) |
|---|---|---|---|---|---|
| Al-4Li-0.2Zr* | 41.8 | 7.3 | 28.1 (LT) | 0.087 | 12.0 |
| Al-5.11Li-0.17 Zr | 47.8 | 4.5 | 13.7 (RC, CR) | 0.085 | 12.5 |

*Hot rolled plate: solution heat treated at 848K, water quenched, aged 16 hrs. at 423K As compared to an Al-4Li-0.2Zr alloy, the Al-5.11Li-0.17Zr material offers distinct advantages in terms of strength, density and stiffness. Ductility and fracture toughness values are not as high in the 5 wt. % Li alloy, however, the properties achieved are more than acceptable for space based structural platforms and components.

Figure 8:
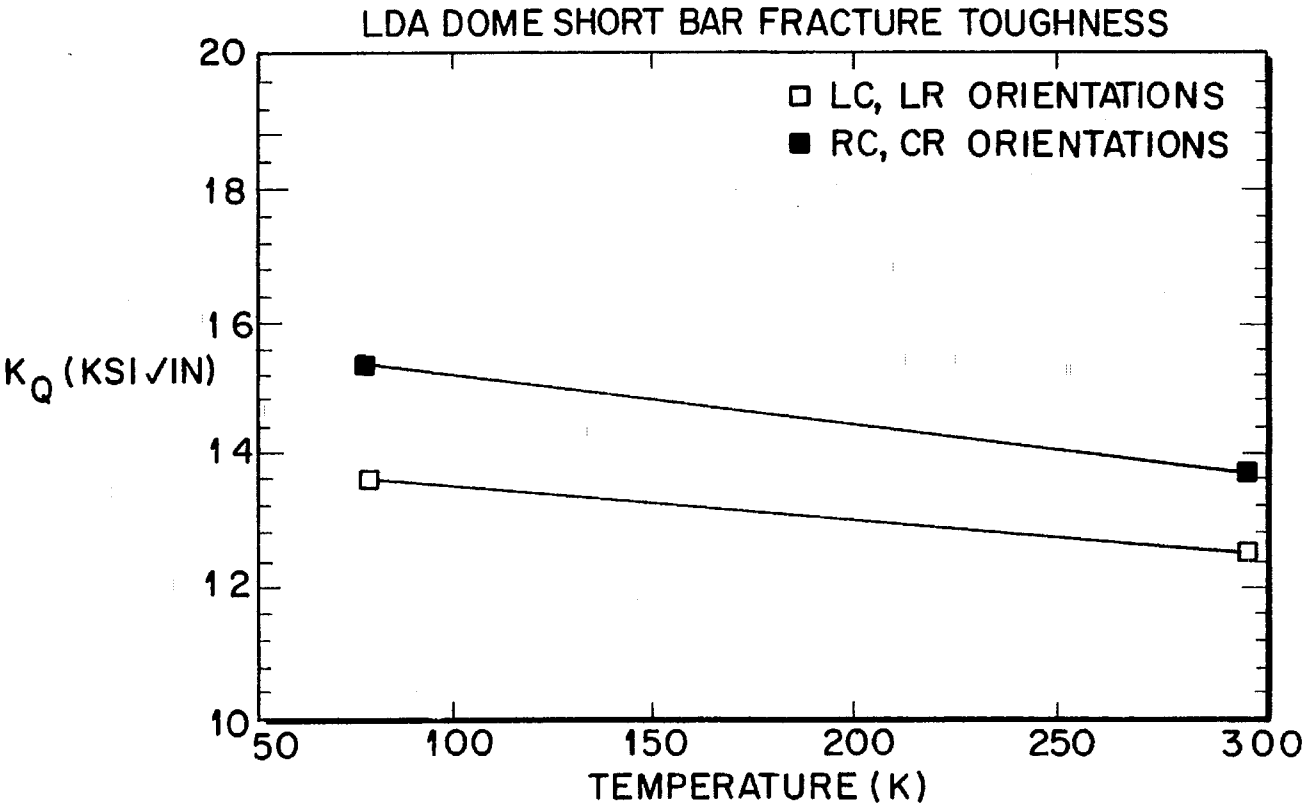
FIG. 8 is a graph plotting apparent fracture toughness as a function of test temperature for the LDA dome.

Apparent fracture toughness of the LDA dome is plotted as a function of test temperature in FIG. 8. As expected, in plane toughness values are the lowest, although for all orientations tested, apparent fracture toughness increases with decreasing temperature.

Figure 9:
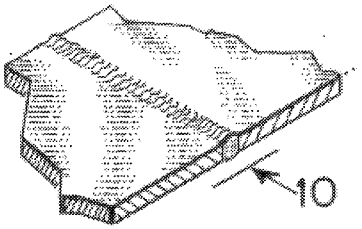
FIG. 9 is a schematic depiction of a welding trial for the LDA dome.

Another advantage of the spray cast Al-Li-Zr alloys of the present invention is that they are easily weldable. An LDA welding trial is shown schematically in FIG. 9.

Figure 10:
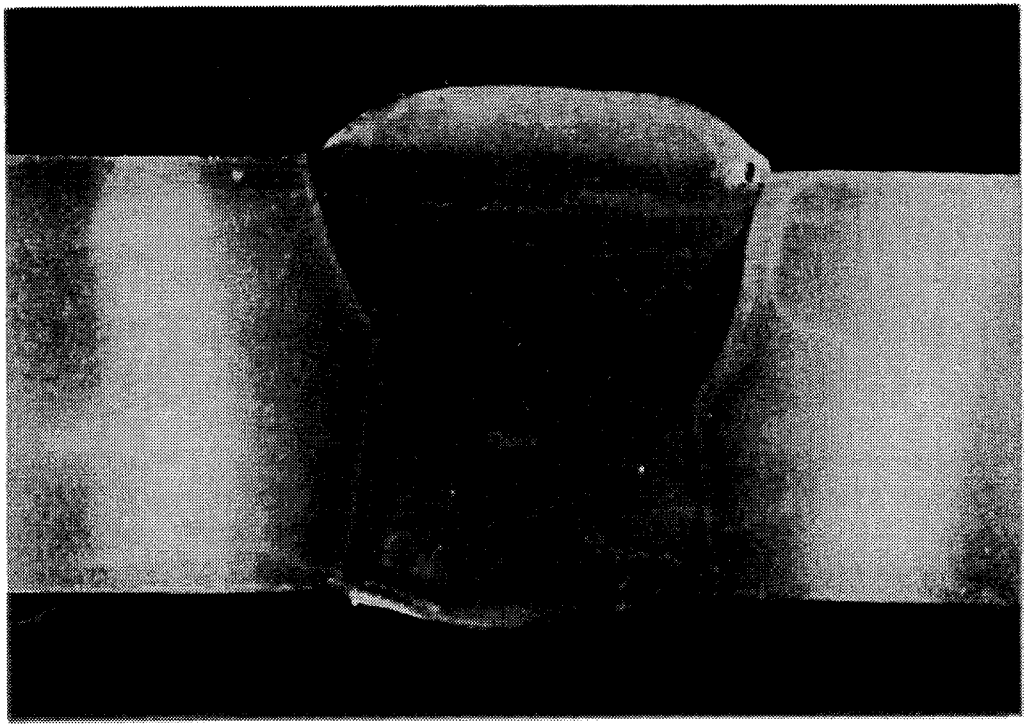
FIG. 10 is a cross section view of a gas-tungsten arc weldment in the heat treated LDA dome material.

FIG. 10 is a photograph which shows a cross-sectional view of an actual gas-tungsten arc weldment in the thermomechanically processed and heat treated LDA dome material of Example 4.

Figure 11:
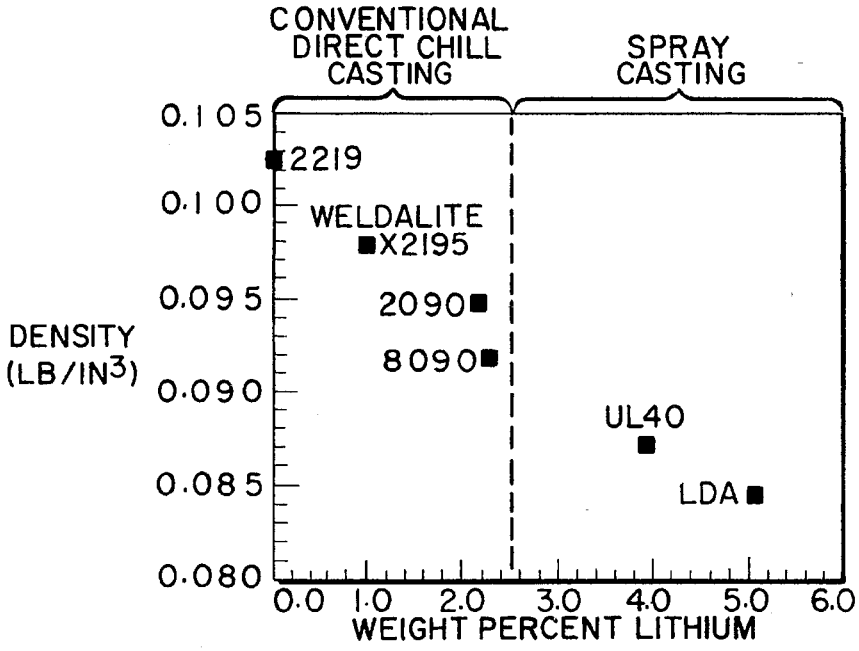
FIG. 11 is a graph plotting density as a function of weight percent lithium which illustrates the favorable comparison of the low density Al-Li-Zr alloy of the present invention (LDA) with other known prior art DC cast and spray cast alloys.
Figure 12:
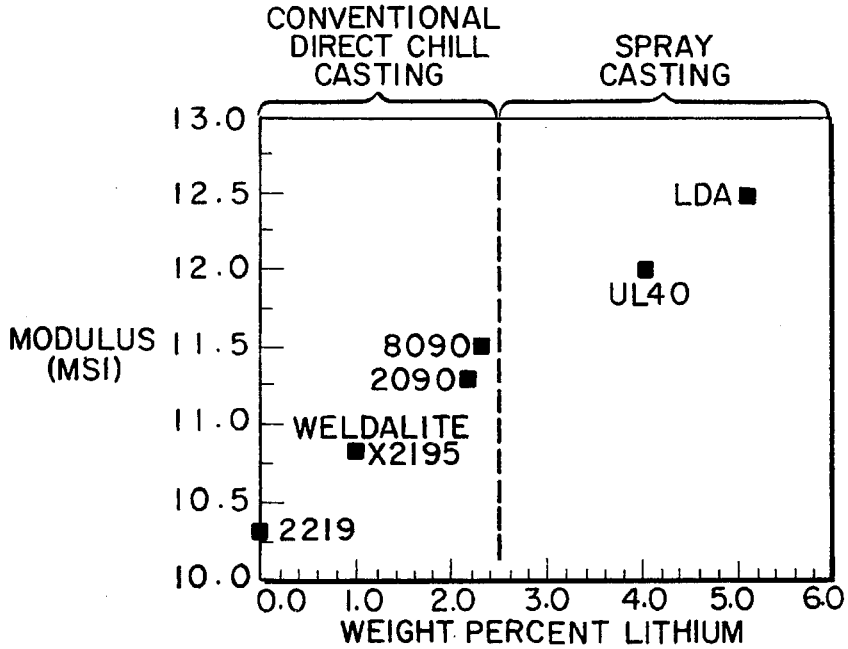
FIG. 12 is a graph plotting modulus as a function of weight percent lithium which illustrates the favorable comparison of the low density Al-Li-Zr alloy of the present invention with other known prior art DC cast and spray cast alloys.

FIGS. 11–12 show density and elastic modulus property comparisons between the Al-Li-Zr alloy of the present invention (indicated in the figure as "LDA") and other prior an low and medium density alloys including a spray cast Al-4.0Li alloy (indicated as UL40) and some conventional DC cast alloys (AA8090, AA2090, Weldalite X2195, and AA2219). It can be seen from the comparison data of FIGS. 11–12 that the Al-Li-Zr alloy (LDA) of the present invention otters significant improvement in weight savings and stiffness over other Al-Li alloys and is therefore ideal for applications where density reduction is critical.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

What is claimed is:

1. A method for producing a low density, high stiffness aluminum alloy which is capable of being processed into structural components having a desired combination of tensile strength, fracture toughness and ductility, comprising the steps of:

a) forming, by spray casting, a solid Al-Li alloy spray cast workpiece consisting essentially of the formula $Al_{bal}Li_aZr_b$ wherein "a" ranges from greater than about 4.4 to 7 wt %, and "b" ranges from 0.08 to 0.6 wt %, the balance being aluminum, said alloy having been solidified at a cooling rate of about $10^2$ to $10^4$ K/sec; and b) thermomechanically working the work piece to eliminate residual porosity that is present in the workpiece as a result of the spray deposition step and to redistribute the δ(AlLi) phase precipitates throughout the microstructure of the workpiece to improve ductility and fracture toughness;

c) the step of thermomechanically working the workpiece is performed by one of the following thermomechanical processing methods:

i) forging at a temperature ranging from about 653° to 823° K.;

ii) rolling at a temperature ranging from about 653° to 823° K.;

iii) extruding at a temperature ranging from about 573° to 823° K.; and d) the workpiece, upon the step of thermomechanically working, having an absence of prior article boundaries.

2. The method according to claim 1 wherein "a" ranges from greater than about 4.4 to 6 wt %, and "b" ranges from greater than about 0.13 to 0.5 wt %.

3. The product of the method of claim 2.

4. The product of the method of claim 1.

5. The method according to claim 1 which further includes the steps of:

solution heat treating said workpiece to maximize the amount of Li in solid solution;

quenching said workpiece to maximize the amount of Li retained in solid solution at room temperature; and aging the workpiece at a temperature in the range of about 413° to 463° K. for a time period ranging about 0.5 to 150 hours to obtain a desired combination of mechanical properties including yield strength, ductility and fracture toughness.

6. The method according to claim 1 which further includes the steps of:

solution heat treating said workpiece to maximize the amount of Li in solid solution;

quenching said workpiece to maximize the amount of Li retained in solid solution at room temperature;

immersing the quenched workpiece in a liquid nitrogen bath allowing the temperature of the workpiece to stabilize followed by upquenching to a temperature in the range of about 293° to 373° K. so as to increase the dimensional stability of the workpiece; and aging the workpiece at a temperature in the range of about 413° to 463° K. for a time period ranging about 0.5 to 150 hours to obtain a desired combination of mechanical properties including yield strength, ductility and fracture toughness.

7. The product of the method of claim 6.

8. The product of the method of claim 5.

9. The method according to claim 1 wherein the step of thermomechanically working the workpiece is performed by the forging method as set forth in claim 1, subparagraph c), i) and which further includes the step of rolling the workpiece at a temperature ranging from about 653° to 823° K.

10. The method according to claim 9 which further includes the steps of:

solution heat treating said workpiece to maximize the amount of Li in solid solution;

quenching said workpiece to maximize the amount of Li retained in solid solution at room temperature; and aging the workpiece at a temperature in the range of about 413° to 463° K. for a time period ranging about 0.5 to 150 hours to obtain a desired combination of mechanical properties including yield strength, ductility and fracture toughness.

11. The method according to claim 9 which further includes the steps of:

solution heat treating said workpiece to maximize the amount of Li in solid solution;

quenching said workpiece to maximize the amount of Li retained in solid solution at room temperature;

immersing the quenched workpiece in a liquid nitrogen bath allowing the temperature of the workpiece to stabilize followed by upquenching to a temperature in the range of about 293° to 373° K. so as to increase the dimensional stability of the workpiece; and aging the workpiece at a temperature in the range of about 413° to 463° K. for a time period ranging about 0.5 to 150 hours to obtain a desired combination of mechanical properties including yield strength, ductility and fracture toughness.

12. The product of the method of claim 11.

13. The product of the method of claim 10.

14. The method according to claim 9 which further includes the step of spin forging the workpiece at a temperature ranging from about 653° to 823° K.

15. The method according to claim 14 which further includes the steps of:

solution heat treating said workpiece to maximize the amount of Li in solid solution;

quenching said workpiece to maximize the amount of Li retained in solid solution at room temperature; and aging the workpiece at a temperature in the range of about 413° to 463° K. for a time period ranging about 0.5 to 150 hours to obtain a desired combination of mechanical properties including yield strength, ductility and fracture toughness.

16. The method according to claim 14 which further includes the steps of:

solution heat treating said workpiece to maximize the amount of Li in solid solution;

quenching said workpiece to maximize the amount of Li retained in solid solution at room temperature;

immersing the quenched workpiece in a liquid nitrogen bath allowing the temperature of the workpiece to stabilize followed by upquenching to a temperature in the range of about 293° to 373° K. so as to increase the dimensional stability of the workpiece; and aging the workpiece at a temperature in the range of about 413° to 463° K. for a time period ranging about 0.5 to 150 hours to obtain a desired combination of mechanical properties including yield strength, ductility and fracture toughness.

17. The product of the method of claim 16.

18. The product of the method of claim 15.

19. The method according to claim 1 wherein the step of thermomechanically working the workpiece is performed by the rolling method as set forth in claim 1, subparagraph c), ii) and which further includes the step of spin forging the workpiece at a temperature ranging from about 653° to 823° K.

20. The method according to claim 19 which further includes the steps of:

solution heat treating said workpiece to maximize the amount of Li in solid solution;

quenching said workpiece to maximize the amount of Li retained in solid solution at room temperature; and aging the workpiece at a temperature in the range of about 413° to 463° K. for a time period ranging about 0.5 to 150 hours to obtain a desired combination of mechanical properties including yield strength, ductility and fracture toughness.

21. The method according to claim 19 which further includes the steps of:

solution heat treating said workpiece to maximize the amount of Li in solid solution;

quenching said workpiece to maximize the amount of Li retained in solid solution at room temperature;

immersing the quenched workpiece in a liquid nitrogen bath allowing the temperature of the workpiece to stabilize followed by upquenching to a temperature in the range of about 293° to 373° K. so as to increase the dimensional stability of the workpiece; and aging the workpiece at a temperature in the range of about 413° to 463° K. for a time period ranging about 0.5 to 150 hours to obtain a desired combination of mechanical properties including yield strength, ductility and fracture toughness.

22. The product of the method of claim 21.

23. The product of the method of claim 20.

24. A spray-cast low density, high stiffness aluminum alloy capable of being processed into structural components having a desired combination of tensile strength, fracture toughness and ductility consisting essentially of the formula $Al_{bal}Li_aZr_b$, wherein "a" ranges from greater than about 4.4 to 7 wt %, and "b" ranges from 0.08 to 0.6 wt %, the balance being aluminum, said spray cast alloy solidified at a cooling rate of about $10^2$ to $10^4$ K/sec and having an absence of prior particle boundaries and having a volume percent of δ phase (AlLi) precipitates greater than about 5%.

25. An alloy as recited in claim 24, wherein "a" ranges from greater than about 4.4 to 6.0 wt %.

26. An alloy as recited in claim 25, wherein "b" ranges from greater than about 0.13 to 0.5 wt %.

27. An alloy as recited in claim 24, wherein "b" ranges from greater than about 0.13 to 0.5 wt %.

28. A component formed from a spray cast billet and consisting essentially of an alloy having the formula $Al_{bal}Li_aZr_b$ wherein "a" ranges from greater than about 4.4 to 7 wt %, and "b" ranges from 0.08 to 0.6 wt %, the balance being aluminum, said spray cast billet being formed at a cooling rate of about $10^2$ to $10^4$ K/sec, said alloy having substantially no porosity and having an absence of prior particle boundaries with δ (AlLi) phase precipitates substantially evenly distributed throughout its microstructure.

29. A component according to claim 28, having a 0.2% offset yield strength ranging from about 30 to 75 ksi, ultimate tensile strength ranging from about 35 to 85 ksi, elongation to failure ranging from about 1 to 10%, and fracture toughness in a longitudinal-transverse orientation ranging from about 10 to 30 ksi√in.

* * * * *